US005744764A

United States Patent [19]

Aschenbrenner et al.

[11] Patent Number: 5,744,764

[45] Date of Patent: Apr. 28, 1998

[54] MODULAR DE-ENERGIZED SWITCH FOR TRANSFORMER TAP CHANGING

[75] Inventors: William R. Aschenbrenner, Waukesha; Thomas M. Golner, Pewaukee; Shirsh Mehta, Waukesha, all of Wis.

[73] Assignee: General Signal Corporation, Stamford, Conn.

[21] Appl. No.: 720,293

[22] Filed: Sep. 26, 1996

[51] Int. Cl.[6] ..... H01H 15/06

[52] U.S. Cl. ..... 200/1 R; 200/16 R

[58] Field of Search ..... 200/1 R, 1 V, 200/1 B, 11 R, 11 A, 11 TC, 16 R, 16 A, 16 C, 16 D, 16 E, 16 F, 17 R, 18, 38 R, 38 E, 33 D, 33 B, 50.32, 50.38, 547, 549, 550, 572, 500, 501, 275

[56] References Cited

U.S. PATENT DOCUMENTS

| | | | |
|---|---|---|---|
| 3,567,891 | 3/1971 | Hinkelmann | 200/166 |
| 3,657,495 | 4/1972 | Charamel et al. | 200/16 B |
| 3,673,364 | 6/1972 | Klein | 200/16 C |
| 3,824,355 | 7/1974 | Norman et al. | 200/16 F |
| 3,857,008 | 12/1974 | Van Der Donk | 200/153 J |
| 4,504,811 | 3/1985 | Stunzi | 336/10 |
| 4,533,797 | 8/1985 | Kranich, II et al. | 200/11 TC |
| 4,562,316 | 12/1985 | Kranich, II | 200/16 D |
| 4,644,112 | 2/1987 | Kranich, II | 200/16 F |
| 4,822,961 | 4/1989 | Hugin et al. | 200/16 R |
| 5,023,418 | 6/1991 | Beckhausen | 200/511 |
| 5,416,286 | 5/1995 | Dixon, Jr. | 200/16 E |

OTHER PUBLICATIONS

Brochure entitled "The MC–Multilam Principle", by Multi–Contact U.S.A., Santa Rosa, California, published prior to 1996.

MagneTek De–Energized Tap Changer, product description, two pages, Jun. 1992.

MagneTek High Current De–Energized Tap Changer, product description, Mar. 1993.

MagneTek De–Energized Dual Voltage Switch, product description, three pages, Jun. 1992.

*Primary Examiner*—Michael L. Gellner
*Assistant Examiner*—Michael A. Friedhofer
*Attorney, Agent, or Firm*—Foley & Lardner

[57] ABSTRACT

A switch for use in transformer tap changing is modular in design, having standardized fixed contact units mounted in alignment on a base. Each contact unit has an electrical contact embedded in an insulating body, with a hollow bore formed through the insulating body and the embedded electrical contact. A cylindrical movable contactor having spaced contact bands is mounted on a shaft to be driven through the hollow bores of the fixed contact units between positions at which its contact bands engage the electrical contacts within adjacent fixed contact units. The electrical contacts of the fixed contact units are connected to different taps of the transformer to allow the transformer turns ratio to be adjusted by changing the position of the movable contactor. The drive shaft is connected by a mechanism to a handle mounted outside the tank of the transformer that can be operated to move the movable contact a selected distance to change the tap connections to the transformer.

27 Claims, 4 Drawing Sheets

MODULAR DE-ENERGIZED SWITCH FOR TRANSFORMER TAP CHANGING

FIELD OF THE INVENTION

This invention pertains generally to the field of high voltage electrical switching apparatus, and more specifically to high current, de-energized switches such as tap changing switches used in power transformers.

BACKGROUND OF THE INVENTION

Large high voltage transformers typically have tap changing mechanisms in conjunction with the primary windings of the transformer to allow the primary to secondary turns ratio to be adjusted. These adjustments are required to compensate for variations in line voltage that depend on the physical distance of the transformer from the power generating point. These adjustments are typically made at the time of installation of the transformer and remain unchanged during the life of the transformer unless changes are made in the power system to which the transformer is connected.

A typical tap changing switch for a transformer includes a series of fixed contacts, connected to the taps of the primary winding of the transformer, which are within the transformer tank and immersed in the transformer oil. A movable contact is driven between the contacts through a drive mechanism connected to a manually operated handle outside the tank of the transformer. Switching of tap positions is done only when no power is being supplied to the transformer. Various constructions for such transformer tap changing switches are shown in U.S. Pat. Nos. 3,673,364, 4,533,797 and 4,562,316. Three tap changing switch structures (or a ganged tap changer with three sets of switches) are required to make the appropriate connections to the three phase primary windings of large transformers. The size of the three conventional tap changing switches and their required spacing for electrical isolation within the transformer generally imposes a constraint on the minimum size of the transformer tank.

The differing requirements of different transformers, including the number of taps required, have generally dictated that the construction of each tap changer be customized to the transformer with which it is to be used, increasing manufacturing costs. Further, complex drive mechanisms may be required to properly index the movement of these contacts within the tap changing switches to ensure that the contacts are moved to their proper positions. For three phase transformers, such operating mechanisms must be capable of simultaneously moving three sets of contacts.

SUMMARY OF THE INVENTION

The switch in accordance with the present invention is modular in design so that it can be readily constructed of standardized parts to accommodate transformers of different sizes and numbers of taps. Its compact construction minimizes the space within the transformer tank occupied by the switch or switches, thereby allowing transformer size to be minimized. Changing of taps is accomplished by a simple, smooth sliding motion of a movable contactor, accommodating the use of simplified drive mechanisms for the movable contactor. Three switches can be readily mounted in a compact side-by-side or end-to-end relationship in which they can be operated by a single drive mechanism operated by a handle outside the transformer tank.

The switch of the present invention includes an elongated insulating base on which several fixed contact units are mounted. Each fixed contact unit is identical in construction, having an insulating body in which an electrical contact is embedded, with a hollow bore formed through the insulating body and the electrical contact. The electrical contact is formed at the middle of the insulating body, spaced away from the openings to the internal bores at each end of the fixed contact unit. Several fixed contract units are mounted in alignment on the base so that their bores are aligned, allowing a movable contactor to be driven through the bores of the fixed contacts by a drive shaft to change switch positions.

The movable contactor is preferably formed substantially as an elongated cylinder of a good electrical conductor, such as copper, with two spaced contact bands formed on the body of the movable contactor. The contact bands preferably have spring loaded portions that extend beyond the diameter of the adjacent body of the movable contactor so as to make tight physical contact with the inner bore of the contacts in the fixed contact units, while allowing the body of the movable contactor to move unimpeded through the bores of the contact units. The spacing between the contact bands on the movable contactor matches the spacing between the electrical contacts in adjacent contact units. When the movable contactor is in position with its contact bands engaging the cylindrical bores of the electrical contacts in adjacent fixed contact units, a low resistance electrical connection is provided at many points across the entire internal periphery of the bore of the electrical contact to the contact band. The body of the electrical contactor is in good electrical contact with the contact bands thereby providing a low resistance electrical connection between the two adjacent fixed contact units.

To change switch positions, the drive shaft is moved to drive the movable contactor through the bores of the fixed contact units until the contact bands of the movable contactor are engaged with the internal bores of electrical contacts in two other adjacent fixed contacts units. The electrical contacts in each fixed contact unit extend out from the insulating body of the fixed contact unit to form a mounting post to which a conductor from the transformer can be connected.

In a preferred construction, which facilitates modular assembly of tap changing switches, the fixed contact units are mounted to the elongated base by engagement of dovetail type flanges on the bottom of the body of each fixed contact unit with mating flared grooves in side walls of a channel formed in the top surface of the base. The fixed contact units can be assembled in position by sliding them one at a time into one end of the channel in the base until the desired number of units are in place, and then blocking the last unit in to fix all of the units in position. In this manner, the internal bores of the plural fixed contact units are mounted in proper alignment.

A preferred mechanism for driving the movable contactor between positions is a rack with gear teeth thereon mounted to the end of the drive shaft and a pinion gear mounted for rotation with its teeth engaged with the teeth of the rack. A shaft extends, directly or through universal couplings to accommodate differences in positions and angles of the coupled parts, from the pinion gear through the wall of the transformer tank to a handle outside the tank so that rotational motion of the handle is translated into linear motion of the rack and the drive shaft attached thereto. Preferably, the size of the pinion gear, and the mating gear teeth on the pinion and the rack, are selected so that one complete turn of the handle results in translation of the movable contactor to the next switch position at which the contact bands of the movable contactor engage with the internal walls of the electrical contacts in the next adjacent pair of fixed contact units. A Geneva gear system may also be used to ensure that one rotation of the handle corresponds to exactly one change in switch position.

Because the fixed contact units can be made with identical construction, the assembly of a tap changing switch for transformers of different sizes and having different numbers of taps can be easily accomplished by simply inserting more or fewer of the fixed units in the channel of the base. Further, three of the tap changing switches, one for each of the three phases of a three phase transformer, may be mounted so that a shaft or shafts coupled to a handle outside of the transformer tank will drive all three pinion gears of the three switches simultaneously as the handle is turned.

The insulating base provides structural support for the fixed and movable contacts, but may be made relatively thin and need only be somewhat wider than the width of the fixed contact units, thereby minimizing the overall height and width of each switch unit and providing a very compact structure. Thus, the volume occupied in the transformer tank by the tap changing switches between the transformer and the walls of the tank is minimal, allowing the overall size of the transformer tank to be minimized. Generally, the relatively elongated tap changing switches of the present invention are readily accommodated within a conventional transformer tank, so that best advantage of the volume of the tank is made by the present invention. If desired, the switch may also be incorporated into a structure in the tank that has other purposes. For example, a structural member used to support cables may be provided with a dove-tail channel, with the fixed contact units then mounted in that channel.

The contact bands of the movable contactor make tight physical and electrical contact with the cylindrical bores of the electrical contacts fixed contact units preferably at multiple positions extending around the entire 360° internal bore periphery. Consequently, the flow of electricity is optimally distributed around the entire inner periphery of the fixed electrical contact and around the entire outer periphery of the movable contactor body adjacent the contact bands, making full use of the entire surface areas of these structures. In this manner, hot spots in the fixed contact and movable contactor are minimized and the sizes of these structures may be minimized for a given level of current to be conducted by these conductors. The contact bands are preferably spring loaded structures which engage the bore of the fixed contact tightly at many points, and which increase the contact pressure on the inside of the fixed electrical contact under short circuit conditions.

Although the switch of the present invention is particularly well suited for use as a tap changing switch, it may be used in other appropriate applications. For example, it may be used with transformers designed for reconnection of internal leads from an external source (e.g., series/parallel reconnectable). Such transformers use pairs of windings per phase which can be connected in series or parallel with one another. Each winding may have taps, requiring switches for that purpose also.

Further objects, features and advantages of the invention will be apparent from the following detailed description when taken in conjunction with the accompanying drawings.

DETAILED DESCRIPTION OF THE INVENTION

Figures 1, 2, 3, 14, 15:
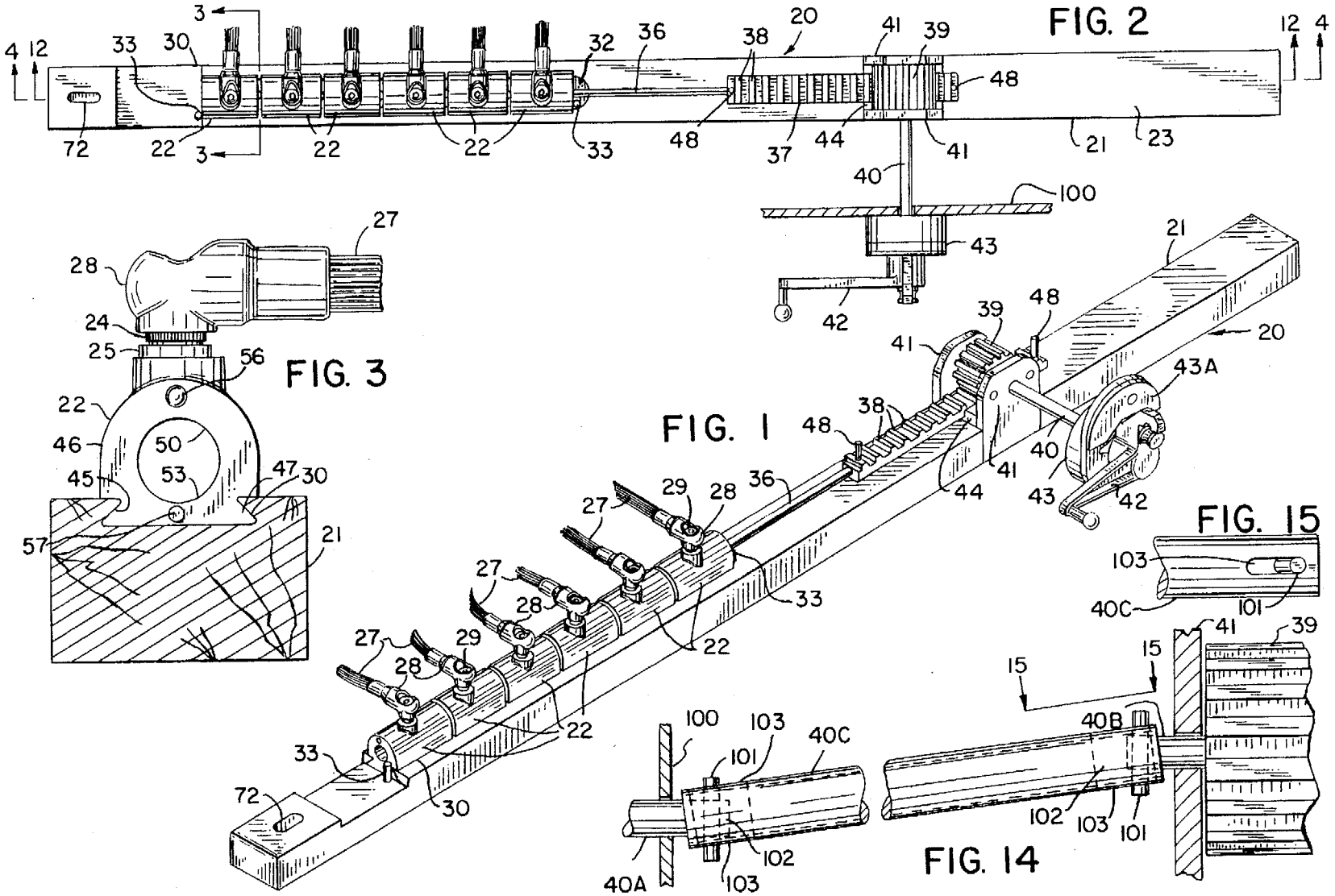
FIG. 1 is a perspective view of a switch for transformer tap changing in accordance with the present invention.
FIG. 2 is a plan view of the switch of FIG. 1.
FIG. 3 is a lateral cross-sectional view of the switch of the invention taken generally along the lines 3—3 of FIG. 2.
FIG. 14 is an elevation view of a preferred universal coupling connecting shaft structure between the handle and the pinion gear of the switch of FIG. 1.
FIG. 15 is a top view of a portion of the connecting shaft structure of FIG. 14.

With reference to the drawings, a switch in accordance with the present invention, which can be connected to the taps on a single phase transformer or to taps on one phase winding of a three phase transformer, is shown generally at 20 in FIG. 1. The switch 20 has an elongated, generally rectangular insulating base 21 on which are mounted a series of fixed contact units 22 aligned in a row along the top face 23 of the base 21. Each of the fixed contact units 22 has an electrical contact post 25 forming part of an electrical contact 26. The post 25 extends from the top of the unit 22. Electrical conducting lines 27, leading to the taps of the transformer (not shown), are connected to the posts 25 by lugs 28 crimped on the ends of each of the conductors 27. The lugs 28 are firmly connected to the posts 25 by Allen-head screws 29, with a spring steel ribbed washer (not shown) preferably used to back the screw and provide additional contact points. The posts 25 preferably have tapered interference fit ridges 24 formed thereon to insure multiple contact points between the posts 25 and the lugs 28 and to prevent rotation of the lug 28. Each of the linearly aligned fixed contact units 22 is mounted to the base 21 in a channel 30 formed in the top face 23 of the base, as described further below. One end 32 of the channel 30 is a blind end at which the channel terminates, while at the other open end of the channel a peg 33 is secured to the base 21 at a notch therein to engage against the last contact unit 22 and prevent the contact units 22 from coming out of the channel. A similar peg 33 is also preferably secured to the base 21 at the other end of the contact units 22 to ensure that the string of units does not move in either direction.

Figure 4:
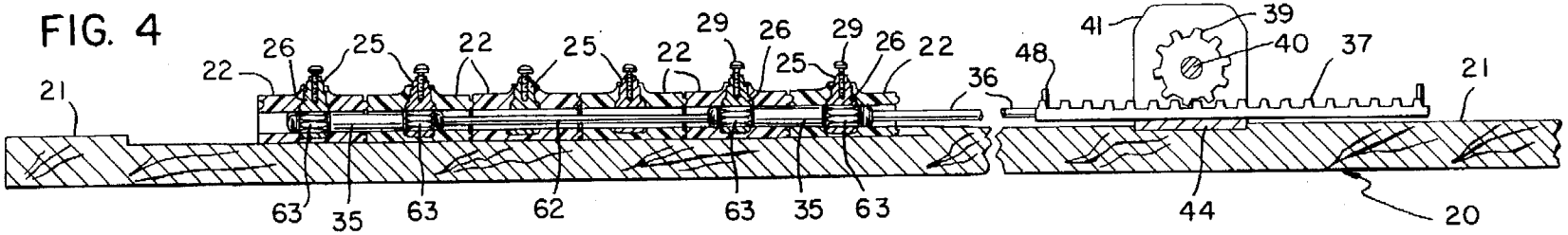
FIG. 4 is a longitudinal cross-sectional view of an embodiment of the switch with multiple movable contactors taken generally along the lines 4—4 of FIG. 2.
Figure 6:
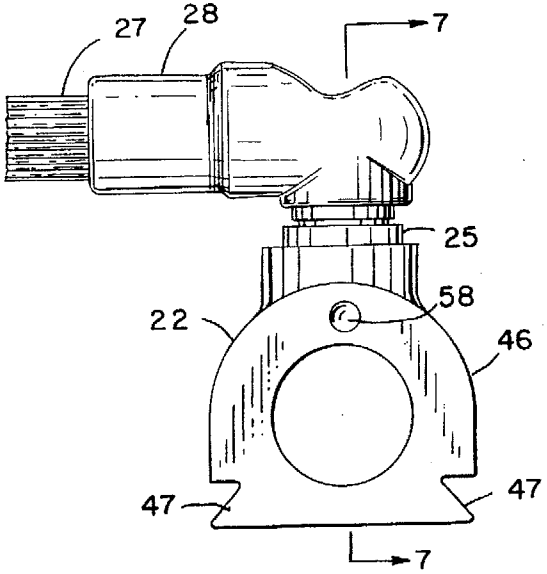
FIG. 6 is an end view of a single fixed contact unit.
Figure 5:
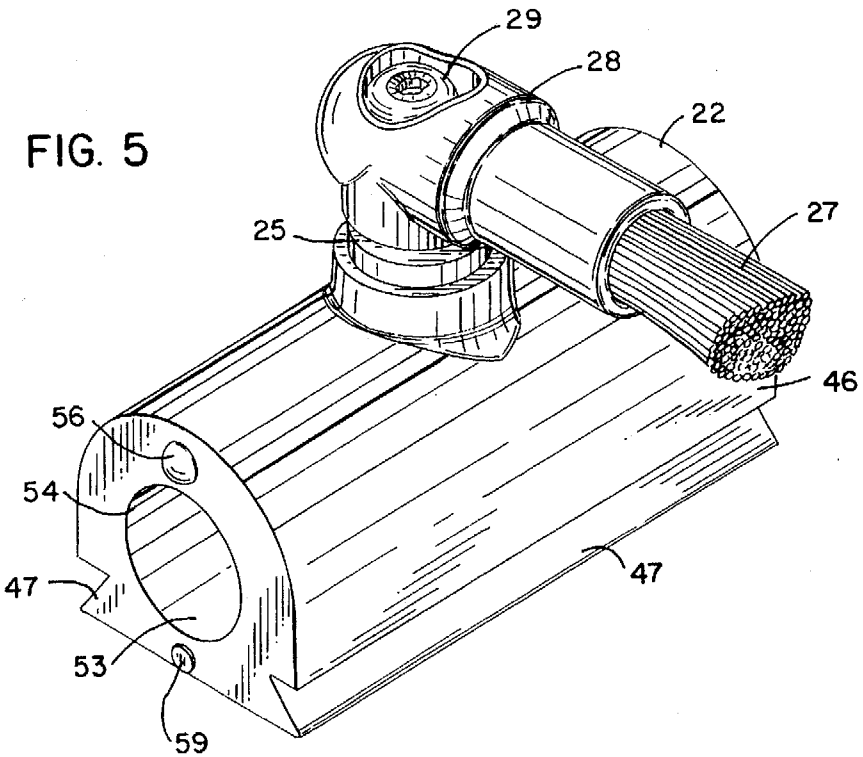
FIG. 5 is a perspective view of a single fixed contact unit.
Figure 12:
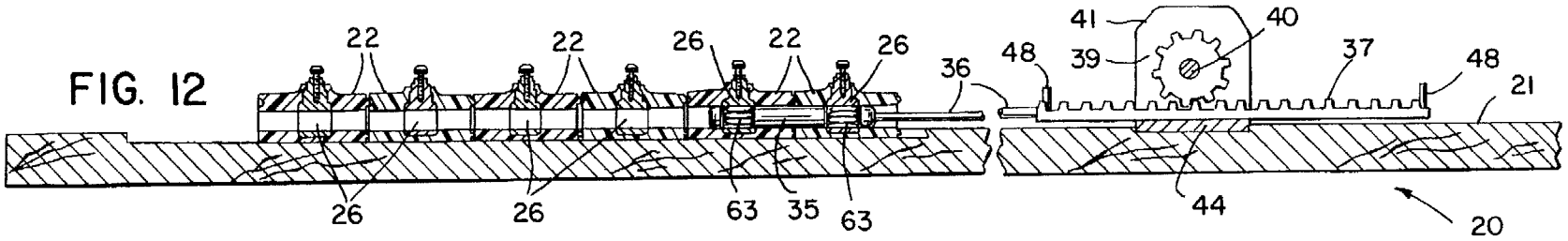
FIG. 12 is a longitudinal cross-sectional view of an embodiment of the switch of the invention with a single movable contactor, taken generally along the lines 12—12 of FIG. 2.

A movable contactor 35 (shown in FIG. 12 or plural contactors 35 shown in FIG. 4) is mounted for motion within the fixed contact units 22 at the end of a drive shaft 36. The drive shaft 36 is attached to the end of an elongated rack 37 having gear teeth 38 formed on its top face. A pinion gear 39 is mounted for rotation on a shaft 40 which is journaled to side panels 41 which are themselves mounted to the base 21, thereby mounting the pinion gear 39 to the base 21 for rotation with its teeth engaged with the teeth of the rack 37. The shaft 40 is connected to a handle 42, either directly or through a gear unit 43. A preferred material for the rack 37 and pinion gear 39 is a linen/epoxy laminated material available under the trademark Spauldite GC 441. The rack 37 slides in a channel of a rack guide 44 on the base 21. The handle 42 is mounted outside the transformer tank wall (shown for illustration at 100 in FIG. 2). An index display unit 43A can be mounted to the handle 42 to indicate to an operator the present tap position. Generally, it is preferred that a single full revolution of the handle 42 correspond to one change of tap position. As is apparent, rotating the handle 42, thereby rotating the shaft 40 and the pinion gear 39 connected to it, drives the rack 37 laterally in one direction or the other to drive the movable contactor in one direction or another. Pegs 48 secured to the ends of the rack 37 prevent the rack from being driven too far when the pegs engage the pinion 39. The handle may be operably connected to the shaft 40 through a Geneva gear system 43, e.g., as generally shown in U.S. Pat. No. 4,533,797, to index the motion of the rack in a step-by-step manner. The Geneva gear system can index an indicator on the display unit 43A as one revolution of the handle 42 is completed to accomplish one switch position change. The Geneva operated indexing system 43 typically can display the current switch position on the display unit 43A by letters e.g., A, B, C, D, or E. These positions can be defined in the transformer nameplate which shows what tap position is being connected at each letter.

It is sometimes necessary or desirable to mount the switch (or switches) 20 within the transformer tank at a position in which the shaft on which the pinion gear 39 rotates is not precisely aligned with the output shaft of the gear system 43. Space considerations inside the tank may dictate that the axis of roation of the pinion gear 39 be slightly offset from or even at an angle to the axis of rotation of the output shaft of the gear system. In such circumstances, the output shaft 40 may comprise a compound structure incorporating universal couplings as illustrated in FIGS. 14 and 15. The exemplary shaft structure 40 shown therein includes an output shaft 40A from the gear system 43 (shown passing through the tank wall 100) which is offset from the shaft 40B on which the pinion gear 39 rotates. An intermediate shaft 40C is connected at its opposite ends to the shafts 40A and 40B by universal couplings formed by roll pins 101 mounted in the ends of the shafts 40A and 40B. The ends of the shafts 40A and 40B extend a short distance into blind holes 102 drilled into the ends of the shaft 40C (or in the hollow bore of a tubular shaft 40C). The pins 101 extend outwardly from the surface of the shafts 40A and 40B into slots 103 formed in the shaft 40C, as best illustrated in FIG. 15. When the shaft 40A is rotated, the pin 101 attched to that shaft will engage the walls of the slots 103 to rotate the intermediate shaft 40C, and similarly the walls of the slots 103 at the opposite end of the shaft 40C will engage the pin 101 attached to the shaft 40B to rotate it.

The mounting of the fixed contact units 22 to the base 20 is illustrated with respect to the lateral cross-sectional view of FIG. 3, which is taken between adjacent fixed contact units 27. The channel 30 in the base has outwardly sloping side walls 45 which form dove-tail type grooves in the sides of the channel 30. Each of the fixed contact units 22 has a solid insulating body 46 with a flat bottom from which extend inwardly flared sides 47 which mate with the sloping side walls 45 forming the grooves in the base channel 30. In assembly of the tap changing switch 20, the contact units 22 can be inserted one at a time into the channel 30 with their flared sides 47 engaging the side walls 45 and be slid into place until stopped either engaging the walls of the blind end 32 of the channel or of the next adjacent contact unit.

The insulating base 21 is preferably formed of a structurally strong material which is essentially electrically non-conductive. A convenient and suitable material for the elongated base 21 is laminated, precompressed pressboard, commonly known as TX Pressboard, which is also readily milled to form the appropriate walls of the channel 30, although various other materials can also be utilized, such as high quality wood, fiberboard, fiberglass composites, plastics, etc. For a base 21 formed of pressboard, it is preferable that the assembled tap changing switch 20 be treated with a conventional vapor phase cycle in which the assembly is heated to extract moisture, after which the base 21 is impregnated with light transformer oil. This treatment also results in the material of the base 21 swelling slightly to tightly bind the contact units 22 within the channel 30. The impregnation of the base with oil will effectively be retained over time inasmuch as the tap changing switch 20, when in use, is submerged in transformer oil in the transformer tank.

Figure 7:
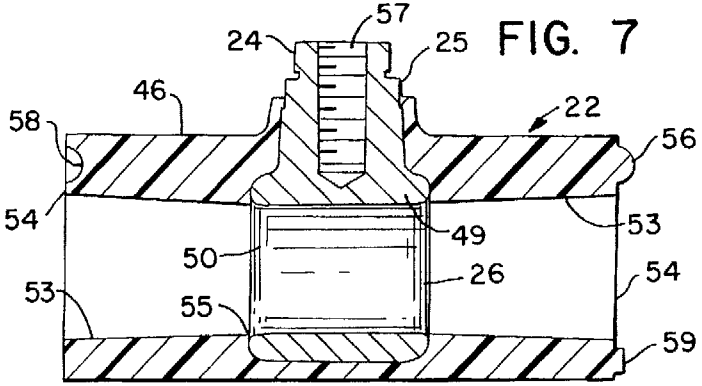
FIG. 7 is a cross-sectional view through a fixed contact unit taken generally along the lines 7—7 of FIG. 6.
Figure 8:
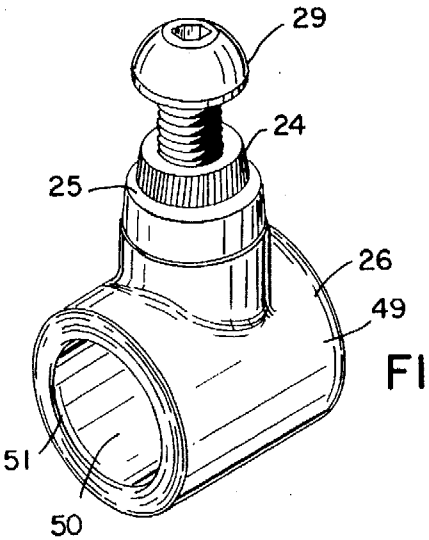
FIG. 8 is a perspective view of the electrical contact for a fixed contact unit.

The detailed construction of the fixed contact units 22 is best illustrated with respect to the views of FIGS. 5–8. Each fixed contact unit 22 is substantially identical in construction, facilitating the modularity of assembly of the switches 20 of the invention. Each unit has a body 46 preferably molded of a structurally strong insulating material, such as cast epoxy. The electrical contact 26 is preferably firmly embedded in the epoxy body 46 by casting liquid epoxy around the contact 23 in a mold and then curing the epoxy. A suitable material for the body is an epoxy with a hydrated alumina filler available from C-K Composites, Inc. of Mount Pleasant, Pa. As illustrated in FIG. 8, the electrical contact 26, formed of a good conductor, such as electrical grade copper, preferably has a substantially barrel shaped body section 49 from which extends the post 25. The barrel shaped body 49 has a central bore 50 which is substantially cylindrical, with a small radius 51 formed at the edges of the bore 50. The insulating body 46 also has a substantially cylindrical bore 53 on both sides of the barrel 49 of the electrical contact, and the bore 53 has a slightly greater diameter than the diameter of the bore 50 of the contact 26. Preferably, as shown in FIG. 7, the bore 53 of the body 46 tapers inwardly from an opening edge 54 to the edge 55 at which it meets the electrical contact 26, but with the diameter of the edge 55 slightly greater than the diameter of the bore 50 of the electrical contact. For exemplification only, the bore 50 may have a diameter of 0.874 inch, the edge 55 may have a diameter of 0.92 inch, with the bore sections 53 tapering outwardly from the edge 55 to the edge 54 at an angle of 1.5°. As illustrated in FIG. 7, the post 25 of the electrical contact has a tapped hole 57 therein, into which the contact bolt 29 can thread to attach the lug 28 firmly in place.

Figure 9:
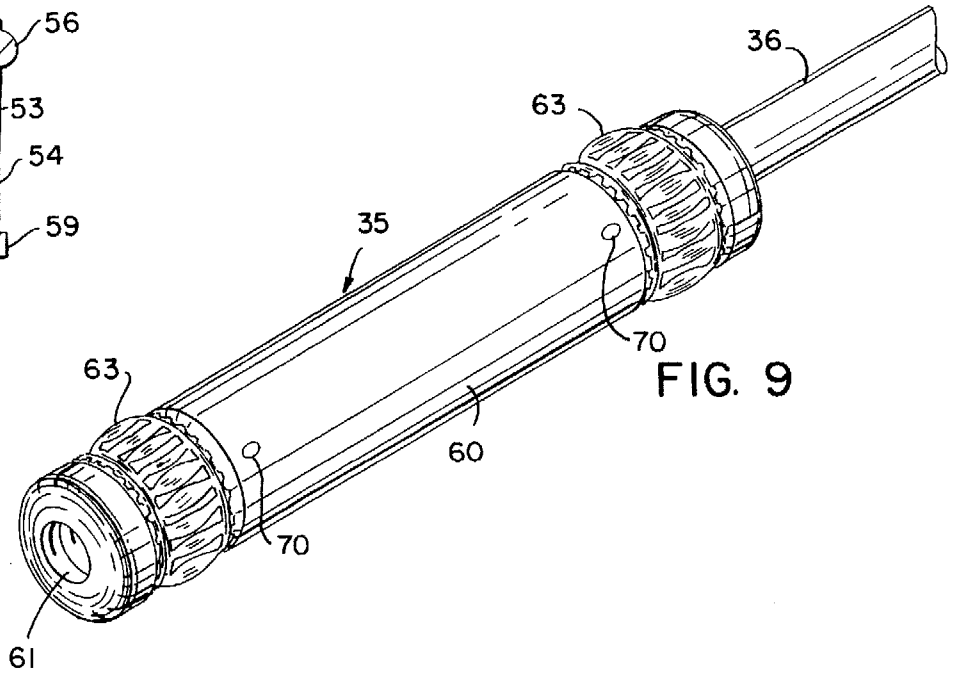
FIG. 9 is a detailed perspective view of the movable contactor that slides within the fixed contact units of the switch.
Figure 10:
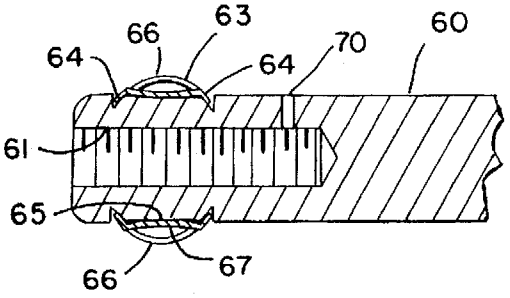
FIG. 10 is a partial cross-sectional view through the movable contactor of FIG. 9, illustrating the mounting of a contact band to the body of the movable contactor.

The preferred construction for the movable contactor 35 is shown in more detail in the views of FIGS. 9 and 10. As illustrated in FIG. 9, the movable contactor 35 has a substantially cylindrical body 60 formed of a good conducting metal, preferably electrical grade copper. The outside diameter of the cylindrical body 60 is preferably slightly less than the inside diameter of the bore 50 of the electrical contact 26, so that the body 60 of the movable contactor will pass relatively freely through both the bore 50 of the contact 26 as well as the somewhat larger bore 53 of the insulating body of the fixed contact unit. For the fixed contact dimensions given above, the diameter of the body 60 may be 0.870 inch. Both ends of the cylindrical body 60 preferably have tapped blind holes 61 therein to allow a threaded end of the drive shaft 36 to be screwed into the hole 61 to firmly mount the contactor 35 at the end of the drive shaft 36. By providing the holes 61 at both ends of the contactor body 60, another contactor 35 can be connected by a short shaft 62 threaded into the holes 61 at each end of the shaft, thereby allowing multiple sets of fixed contacts to be electrically connected to one another at each position of the switch, as illustrated in the cross-sectional view of FIG. 4. The drive shaft 36 and the shaft 62 connecting two of the contactors 35 are preferably formed of a good electrically insulating material, such as epoxy-fiberglass composites, e.g., G10 fiberglass/epoxy molded material.

To assure proper spacing and alignment of the string of fixed contact units 22, a bulge or dimple 56 is formed on one end surface of the body 46 adjacent to the opening to the bore 53. A corresponding recess 58 is formed on the opposite end surface of the body 46 of each unit 22 to receive a corresponding dimple 56 from an adjacent fixed contact unit 22. Engagement of the dimple 56 into the recess 58 helps to ensure proper alignment of the fixed contact units. In addition, a small boss 59 is preferably formed on an end face of the unit extending out somewhat less than the dimple 56 to keep the adjacent fixed contact units slightly spaced apart, thereby, among other things, allowing transformer oil to flow somewhat freely into and out of the bores of the contact units 22.

The movable contactor 35 preferably has spring loaded contact bands 63 mounted to the cylindrical body 60 at spaced positions near the ends of the cylindrical body. The mounting of the band 63 to the cylindrical body 60 is best shown with respect to the cross-sectional view of FIG. 10. In a preferred structure, where each band 63 is to be mounted two spaced grooves 64 are formed in the periphery of the cylindrical body 60. The grooves 64 are separated by a cylindrical area 65 which is preferably machined down slightly from the diameter of the rest of the cylindrical body 60. For example, for a body diameter of 0.870 inch the area 65 may have a diameter of 0.816 inch. The bands 63 are formed of a corrugated metal contact structure which has spring loaded raised sections 66 generally separated by intermediate sections 67 which contact the depressed areas 65. The raised sections 66 extend outwardly beyond the diameter of the adjacent surface of the cylindrical body 60. The extending spring loaded sections 66 of the bands 63 extend out to a diameter which is greater than the inside diameter of the bores 50 of the electrical contacts within the fixed contact units, thus ensuring a tight physical contact between the spring loaded sections 66 at many positions around the entire 360° periphery of the internal bore 50. Suitable contact bands 63 are available commercially from Multi-Contact USA, Santa Rosa, Calif., under the trademark MC-Multilam, such as type LAI in 0.10 mm and 0.125 mm thickness. Each of the bands 63 is wrapped around the periphery of the body 60 between the grooves 64 and secured in place, for example, using retaining rings engaging the edges of the band 63 at each groove 64. The contact pressure between the contact section 66 and the walls of the bore 50 in contact therewith will increase under short circuit conditions to minimize the contact resistance.

As illustrated in FIG. 10, the drive shaft 36, or a shaft 62 connecting one movable contactor 35 to another, can be pinned firmly in place in the contactor by a pin inserted in a hole 70 formed in the contactor body 60 extending from the external periphery to the hole 61.

The spacing between the conducting bands 63 on the movable contactor 35 and the spacing between the center points of the electrical contacts 26 in adjacent fixed contact units 22, when such units are engaged to one another, are selected to match. Although it is desirable that the fixed contact units 22 be of standardized construction and size, the bodies of the units 22 may be made larger or smaller in length to provide different spacing between the electrical contacts 26 in adjacent contact units. Alteratively, and preferably, spacers (not shown) of insulating material may be mounted between adjacent contact units 22 to provide a desired greater spacing between such units. The length of the cylindrical movable contactor 35 will then be greater, allowing for greater spacing between the contact bands 63 to match the new spacing between the adjacent fixed contact units.

Of course, it is apparent that other types of contacts may be used for the contact bands 63, or the contact bands 63 may be formed integrally with the body 60, and spring loaded contacts may alternatively be provided on the interior of the fixed electrical contact 26.

Figure 11:
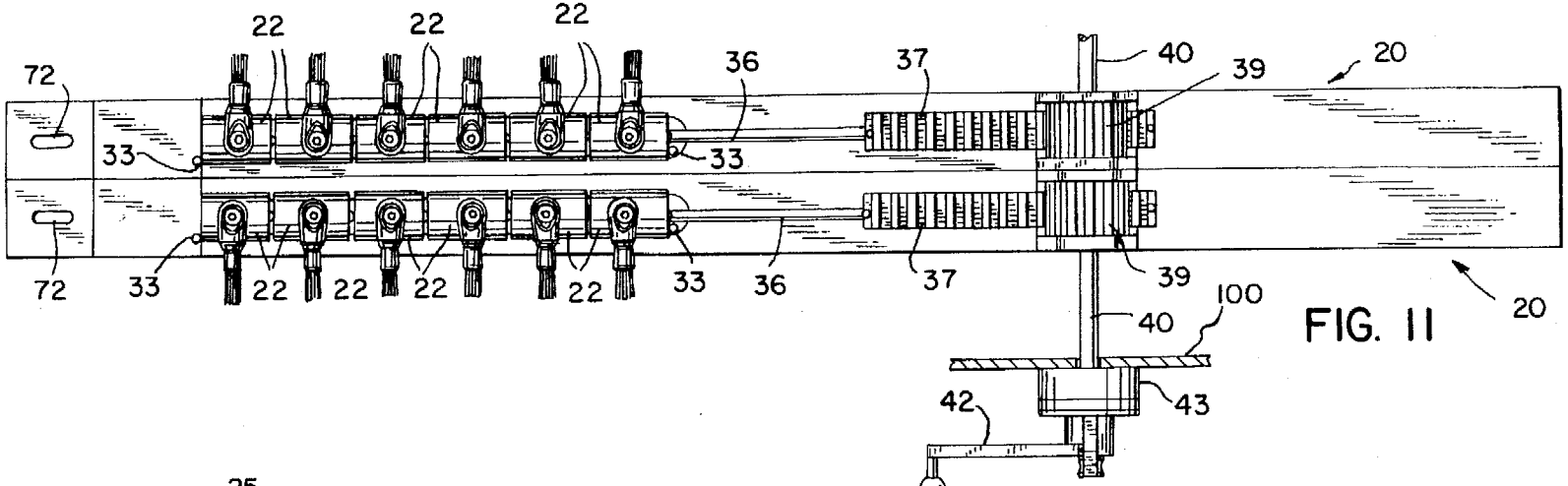
FIG. 11 is a top plan view showing the mounting of two of the three (or more) tap changing switches for a three phase transformer, all operated simultaneously by a single handle extending out of the tank of the transformer.

The present invention is particularly suited to be used with three phase transformer systems since identical tap changing switches 20 may be placed in parallel relationship, as illustrated in FIG. 11, showing two of the three tap changing switches 20 mounted within the tank of a three phase transformer. The three switches can be operated a single shaft 40, on which each of the pinion gears 39 is mounted, to rotate the pinion gears simultaneously and thereby drive the movable contactors 35 within each of the switches 20 by the same distance. The switches 20 may also be operated with universal coupling shaft structures as shown in FIGS. 14 and 15 to allow non-aligned mounting of the switches within the tank. The switches 20 can be firmly mounted to stringers within the transformer tank by bolting the bases 21 to the stringers using bolt holes 72 formed in the bases 21 near one end (or both ends). The third switch (not shown in FIG. 11) preferably is mounted within the transformer tank spaced from the other two at a distance that preferably yields the smallest overall tank size, but with the operating shaft 40 either in line or approximately in line so that the switches can be connected with universal coupling shafts. This position is typically between two adjacent transformer coils, e.g., in the space left open between two adjacent round coils. Because the switch of the present invention has a narrow profile which allows it to be tucked into this space, the switch is no longer a controlling factor in tank size. If desired, a switch can also be mounted on top of the transformer core and coils, and because of its low and narrow profile does not require increased tank height for such mounting.

Figure 13:
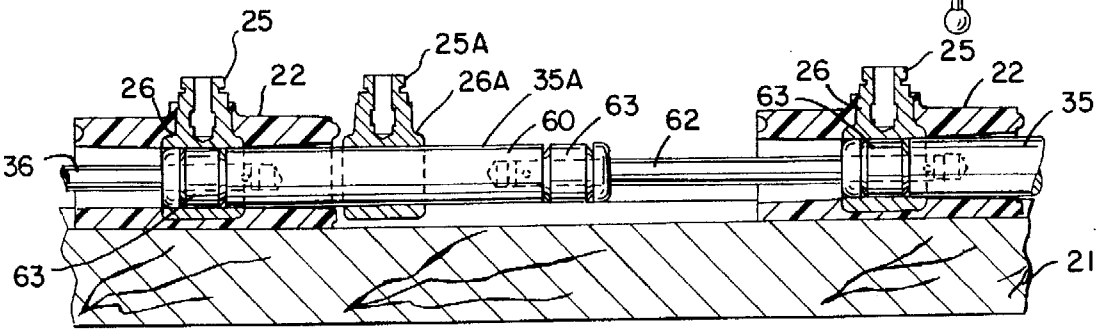
FIG. 13 is a partial cross-sectional view of another embodiment of the switch of the invention.

The present invention lends itself to various adaptations and modifications, all of which will be apparent from the teaching of the invention. An example of such a modified embodiment within the scope of the invention is illustrated in FIG. 13, a longitudinal cross-sectional view through a switch having two fixed contact units 22 that are spaced apart. Each of the fixed contact units may be identical to the fixed contact units described above. A movable contactor 35A is attached to the end of the drive shaft 36 and may be connected by an intermediate shaft 62 to another movable contactor 35, in a manner similar to that shown above for the switch of FIG. 4. Because the two fixed contact units 22 in FIG. 13 are spaced apart, the movement of the movable contactor 35A does not result in a connection between the electrical contacts 26 in adjacent fixed contact units. Instead, in this embodiment, an electrical contact 26A, which may be similar to the electrical contacts 26 embedded within the fixed contact units 22, is in rigid mechanical and good electrical contact with the center of the cylindrical body 60 of the movable contactor 35A. For example, the contact 26A may be brazed onto the body 60 of the contactor 35A to provide the desired electrical continuity and mechanical connection. The construction of the cylindrical body 60 and the contact bands 63 may be identical to that described above for the movable contactors 35. Electrical conducting lines (not shown in FIG. 13) are connected to the contact posts 25 of the spaced fixed contact units 22 in the same manner as described above, and an electrical conducting line (not shown in FIG. 13) may be connected to the post 25A of the contact 26A in the same manner as described above for the connection of the conducting lines 27 to the post 25 of the fixed contact units. When the movable contactor 35A is in the position shown in FIG. 13, electrical continuity is provided between a conducting line connected to the post 25 of the left-hand fixed contact unit 22 and a conducting line connected to the post 25A of the movable contact 35A. When the drive shaft 36 drives the movable contactor 35A to the right, that connection is broken, and a new connection is made to provide electrical continuity between the conducting line connected to the post 25A and a conducting line connected to the post 25 of the right-hand fixed contact unit 22 shown in FIG. 13.

Although well suited to use as a tap changing switch, the switch 20 of the present invention may be used in any appropriate application, particularly where switches capable of carrying high current with low loss are required and switching can be done under de-energized conditions.

It is also understood that the invention is not limited to the particular construction and arrangement of parts herein illustrated and described, but embraces all such modified forms thereof as come within the scope of the following claims.

What is claimed is:

1. A switch comprising:

(a) an insulating base;

(b) a plurality of fixed contact units mounted in aligned position on the base, each contact unit comprising an insulating body with a hollow bore therethrough and an electrical contact embedded in the insulating body and having a bore aligning with the bore of the body and having a contact post portion extending out of the insulating body, the fixed contact units mounted to the base so that the bores of the insulating bodies and electrical contacts of the fixed contact units are linearly aligned;

(c) a movable contactor mounted to move within the bores of the insulating bodies and the electrical contacts of the fixed contact units, the movable contactor having a cylindrical conductive body with two contact bands at spaced positions on the cylindrical body with the cylindrical body providing electrical conduction between the contact bands, the movable contactor sized to slide within the fixed contact units with the contact bands sized to engage the electrical contacts within the fixed contact units; and (d) a drive shaft attached to the movable contactor so that the movable contactor can be driven through the bores of the fixed contact units by moving the drive shaft whereby the movable contactor can be moved from a position in which one of the contact bands of the movable contactor engages the electrical contact in a first of the fixed contact units to a position wherein the one contact band engages the electrical contact within another of the fixed contact units.

2. The switch of claim 1 including a handle and means operable by turning the handle for driving the drive shaft to move the movable contactor a selected distance within the fixed contact units.

3. The switch of claim 2 wherein the means operable by turning the handle comprises a rack with gear teeth thereon attached to the drive shaft, a pinion gear with gear teeth thereon operatively engaged with the teeth of the rack, and a shaft operably mounted to turn the pinion gear and connected to the handle to be turned by the handle.

4. The switch of claim 1 wherein the base is an elongated member having a top surface with a channel formed therein with channel side walls which slope outwardly to form dove-tail type grooves at the sides of the channel, and wherein the body of each fixed contact unit has a bottom section formed to fit within the channel with flared sides that engage in the dove-tail grooves of the channel so that each of the fixed contact units can slide into the channel and be held into place mounted on the base by the flared sides engaged with the side walls of the channel.

5. The switch of claim 4 wherein one end of the channel terminates in a blind end to block further sliding of the fixed contact units within the channel and including a block mounted to the base to close the end of the channel opposite to the blind end and to engage an adjacent fixed contact unit and prevent any motion within the channel of the fixed contact units held within the channel.

6. The switch of claim 1 wherein for each of the fixed contact units the diameter of the internal bore of the electrical contact is smaller than the diameter of the internal bore in the insulating body of the fixed contact unit on either side of the electrical contact.

7. The switch of claim 6 wherein the bore in the body of the fixed contact unit tapers from a larger diameter to a smaller diameter from each end of the body to a position at which the body meets the electrical contact embedded therein and wherein the diameter of the bore in the body at positions adjacent to the electrical contact within the fixed contact unit is slightly larger than the diameter of the bore of the electrical contact.

8. The switch of claim 1 wherein the electrical contact in each of the fixed contact units is a copper electrical contact with a cylindrical internal bore and wherein the body of each of the fixed contact units is formed of a moldable material molded about the electrical contact to embed the electrical contact in the molded body spaced from ends of the molded body.

9. The switch of claim 1 wherein the movable contactor has a generally elongated cylindrical body of conductive metal and wherein pairs of grooves are formed in the periphery of the cylindrical body at spaced positions, and the contact bands are mounted to the cylindrical body at the spaced grooves and have spring loaded sections which extend above adjacent portions of the cylindrical body and sections which are in contact with the cylindrical body.

10. The switch of claim 9 wherein the elongated cylindrical body of the movable contactor has ends with tapped holes therein, and wherein the drive shaft is threadingly engaged within one of the holes in the cylindrical body to attach the movable contactor to the drive shaft.

11. The switch of claim 1 wherein the post of each fixed contact unit includes a tapped hole therein with a threaded screw engaged in the hole securing a lug connected to a conductor leading to a tap of a transformer.

12. The switch of claim 1 wherein the fixed contact units are in engagement with one another with the bore of the electrical contact within each fixed contact unit spaced from the bore of the electrical contact in adjacent ones of the fixed contact units, and the spacing of the contact bands on the movable contactor matches the spacing of the bores of the electrical contacts within adjacent ones of the fixed contact units, whereby the movable contactor can be moved from a position in which the contact bands engage the electrical contacts in a first two of the adjacent contact units to a position in which the contact bands engage the electrical contacts in another two of the fixed contact units.

13. The switch of claim 12 wherein there are at least four of the fixed contact units and there are at least two of the movable contactors attached together by a shaft, one of the movable contactors also attached to the drive shaft.

14. The switch of claim 1 wherein two of the fixed contact units are spaced apart and wherein the movable contactor has an electrical contact attached thereto by which the movable contactor can be electrically connected to a conducting line, and wherein the movable contactor can be moved from a position in which one of the contact bands on the movable contactor is engaged with the electrical contact in a first of the spaced fixed contact units to a position in which the other contact band is engaged with the electrical contact in the second of the spaced fixed contact units.

15. A switch comprising:

(a) an insulating base wherein the base is an elongated member having a top surface with a channel formed therein with channel side walls which slope outwardly to form dove-tail type grooves at the sides of the channel;

(b) a plurality of fixed contact units mounted in aligned position on the base in engagement with one another, each contact unit comprising an insulating body with a hollow bore therethrough and an electrical contact embedded in the insulating body and having a bore aligning with the bore of the insulating body and having a contact post portion extending out of the insulating body, the fixed contact units mounted to the base so that the bores of the insulating bodies and the electrical contacts of the fixed contact units are linearly aligned, wherein the body of each of the fixed contact units has a bottom section formed to fit within the channel of the base with flared sides that engage in the dove-tail grooves of the channel so that each of the fixed contact units can slide into the channel and be held into place mounted on the base by the flared sides engaged with the side walls of the channel;

(c) a movable contactor mounted to move within the bores of the insulating bodies and the electrical contacts of the fixed contact units, the movable contactor having a cylindrical conductive body with two contact bands at spaced positions on the cylindrical body with the cylindrical body providing electrical conduction between the contact bands, the movable contactor sized to slide within the fixed contact units with the contact bands sized to engage the electrical contacts within the fixed contact units;

(d) a drive shaft attached to the movable contactor so that the movable contactor can be driven through the bores of the fixed contact units by moving the drive shaft, whereby the movable contactor can be moved from a position in which one of the contact bands of the movable contactor engages the electrical contact in a first of the fixed contact units to a position wherein the one contact band engages the electrical contact within another of the fixed contact units; and (e) a handle and a rack with gear teeth thereon attached to the drive shaft, a pinion gear with gear teeth thereon operatively engaged with the teeth of the rack, and a shaft operably mounted to turn the pinion gear and connected to the handle to be turned by the handle.

16. The switch of claim 15 wherein one end of the channel terminates in a blind end to block further sliding of the fixed contact units within the channel and including a block mounted to the base to close the end of the channel opposite to the blind end and to engage an adjacent one of the fixed contact units and prevent any motion within the channel of the fixed contact units held within the channel.

17. The switch of claim 15 wherein for each of the fixed contact units the diameter of the internal bore of the electrical contact is smaller than the diameter of the internal bore in the insulating body of the fixed contact unit on either side of the electrical contact.

18. The switch of claim 17 wherein the bore in the body of the fixed contact unit tapers from a larger diameter to a smaller diameter from each end of the body to a position at which the body meets the electrical contact embedded therein and wherein the diameter of the bore in the body at positions adjacent to the electrical contact within the fixed contact unit is slightly larger than the diameter of the bore of the electrical contact.

19. The switch of claim 17 wherein the electrical contact in each of the fixed contact units is a copper electrical contact with a cylindrical internal bore and wherein the body of each of the fixed contact units is formed of a moldable material molded about the electrical contact to embed the electrical contact in the molded body spaced from ends of the molded body.

20. The switch of claim 17 wherein the movable contactor has a generally elongated cylindrical body of conductive metal and wherein pairs of grooves are formed in the periphery of the cylindrical body at spaced positions and the contactor bands are mounted to the cylindrical body at the spaced grooves and have spring loaded sections which extend above adjacent portions of the cylindrical body and sections which are in contact with the cylindrical body.

21. The switch of claim 20 wherein the elongated cylindrical body of the movable contactor has ends with tapped holes therein, and wherein the drive shaft is threadingly engaged within one of the holes in the cylindrical body to attach the movable contactor to the drive shaft.

22. The switch of claim 15 wherein the post of each fixed contact unit includes a tapped hole therein with a threaded screw engaged in the hole securing a lug connected to a conductor leading to a tap of a transformer.

23. A contact unit for a modular switch comprising:

an insulating body with a hollow bore therethrough and a single electrical contact embedded in the insulating body and having a bore aligning with the bore of the insulating body and having a contact post portion extending out of the insulating body, the insulating body having a bottom section formed with flared sides, the diameter of the internal bore of the electrical contact being smaller than the diameter of the internal bore in the insulating body of the contact unit on either side of the electrical contact.

24. The contact unit of claim 23 wherein the electrical contact is a copper electrical contact with a cylindrical internal bore and wherein the insulating body of the contact unit is formed of a moldable material molded about the electrical contact to embed the electrical contact in the molded body.

25. The contact unit of claim 24 wherein the insulating body is molded of epoxy.

26. The contact unit of claim 23 wherein the post of the contact unit includes a tapped hole therein and a threaded screw engaged in the hole to secure a lug connected to a conductor.

27. A contact unit for a modular switch comprising:

an insulating body with a hollow bore therethrough and an electrical contact embedded in the insulating body and having a bore aligning with the bore of the insulating body and having a contact post portion extending out of the insulating body, the insulating body having a bottom section formed with flared sides, the diameter of the internal bore of the electrical contact being smaller than the diameter of the internal bore in the insulating body of the contact unit on either side of the electrical contact, wherein the bore in the insulating body of the fixed contact unit tapers from a larger diameter to a smaller diameter from each end of the body to a position at which the body meets the electrical contact embedded therein and wherein the diameter of the bore in the body at positions adjacent to the electrical contact within the fixed contact unit is slightly larger than the diameter of the bore of the electrical contact.

* * * * *